US009476273B2

(12) United States Patent
Acosta et al.

(10) Patent No.: US 9,476,273 B2
(45) Date of Patent: Oct. 25, 2016

(54) PRESSURE ACTIVATED DOWN HOLE SYSTEMS AND METHODS

(71) Applicant: Halliburton Energy Services, Inc., Houston, TX (US)

(72) Inventors: Frank Acosta, Duncan, OK (US); Lonnie Carl Helms, Duncan, OK (US); John Key, Duncan, OK (US); Nicholas Budler, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 541 days.

(21) Appl. No.: 13/662,695

(22) Filed: Oct. 29, 2012

(65) Prior Publication Data

US 2013/0180731 A1 Jul. 18, 2013

Related U.S. Application Data

(63) Continuation-in-part of application No. 13/350,030, filed on Jan. 13, 2012, now abandoned.

(51) Int. Cl.

| | |
|---|---|
| ***E21B 23/06*** | (2006.01) |
| ***E21B 33/128*** | (2006.01) |
| ***E21B 34/10*** | (2006.01) |
| ***E21B 23/04*** | (2006.01) |

(Continued)

(52) U.S. Cl.

CPC ..... *E21B 23/06* (2013.01); *E21B 23/04* (2013.01); *E21B 33/12* (2013.01); *E21B 33/128* (2013.01); *E21B 34/103* (2013.01); *E21B 41/00* (2013.01); *E21B 2034/007* (2013.01)

(58) Field of Classification Search

CPC ..... E21B 2034/007; E21B 34/14; E21B 23/00–23/14; E21B 33/127

See application file for complete search history.

(56) References Cited

U.S. PATENT DOCUMENTS 1,883,071 A * 10/1932 Stone ..... 166/194
2,715,444 A 8/1955 Fewel (Continued)

FOREIGN PATENT DOCUMENTS

WO 2013106228 A2 7/2013
WO 2014070552 A1 5/2014

OTHER PUBLICATIONS

International Search Report and Written Opinion for PCT/US2013/020082 dated Apr. 9, 2014.

(Continued)

*Primary Examiner* — Blake Michener
(74) *Attorney, Agent, or Firm* — McDermott Will & Emery LLP; Craig Roddy

(57) ABSTRACT

Systems and methods for activating a down hole tool in a wellbore. A trigger is moveably positioned in the interior of a base pipe and includes a first end and a second, smaller end. The trigger is moveable between an unactivated position where a port in the base pipe is blocked and an activated position where the port is open. At least one latch member prevents movement of the trigger from the unactivated position to the activated position until a predetermined force is applied to the trigger. Increasing pressure in the interior increases a force differential between the first end and the second end. When the force differential is substantially equal to the predetermined force, the latch releases and allows the trigger to move from the unactivated position to the activated position, thereby opening the port to permit activation of the down hole tool.

16 Claims, 2 Drawing Sheets

(51) Int. Cl.

| | |
|---|---|
| ***E21B 41/00*** | (2006.01) |
| ***E21B 33/12*** | (2006.01) |
| *E21B 34/00* | (2006.01) |

(56) References Cited

U.S. PATENT DOCUMENTS

| | | | | |
|---|---|---|---|---|
| 2,925,865 | A | 2/1960 | Oliver | |
| 3,000,443 | A | 9/1961 | Thompson | |
| 3,524,503 | A | 8/1970 | Baker | |
| 4,330,039 | A | 5/1982 | Vann et al. | |
| 4,583,593 | A | 4/1986 | Zunkel et al. | |
| 5,279,370 | A * | 1/1994 | Brandell | E21B 33/128 166/184 |
| 5,911,277 | A | 6/1999 | Hromas et al. | |
| 6,293,342 | B1 | 9/2001 | McGarian et al. | |
| 7,080,693 | B2 | 7/2006 | Walker et al. | |
| 8,167,047 | B2 * | 5/2012 | Themig et al. | 166/317 |
| 8,291,980 | B2 * | 10/2012 | Fay | 166/317 |
| 9,027,653 | B2 | 5/2015 | Budler et al. | |
| 9,243,480 | B2 * | 1/2016 | Acosta | E21B 23/00 |
| 2003/0127227 | A1 * | 7/2003 | Fehr et al. | 166/306 |
| 2003/0155118 | A1 | 8/2003 | Sonnier et al. | |
| 2006/0169463 | A1 * | 8/2006 | Howlett | 166/386 |
| 2006/0196678 | A1 | 9/2006 | Connell et al. | |
| 2006/0213656 | A1 | 9/2006 | Clifton | |
| 2007/0119599 | A1 | 5/2007 | Chavers et al. | |
| 2009/0095486 | A1 | 4/2009 | Williamson, Jr. | |
| 2010/0101807 | A1 | 4/2010 | Greenlee et al. | |
| 2010/0300703 | A1 | 12/2010 | Christie et al. | |
| 2011/0030975 | A1 * | 2/2011 | Duphorne | 166/386 |
| 2011/0036585 | A1 | 2/2011 | Sinclair | |
| 2011/0036592 | A1 * | 2/2011 | Fay | 166/374 |
| 2011/0127047 | A1 * | 6/2011 | Themig et al. | 166/386 |
| 2012/0181732 | A1 | 7/2012 | Stephenson et al. | |
| 2013/0180732 | A1 | 7/2013 | Acosta et al. | |
| 2014/0116721 | A1 | 5/2014 | Hofman et al. | |
| 2015/0292295 | A1 | 10/2015 | Acosta et al. | |

OTHER PUBLICATIONS

International Preliminary Report on Patentability for PCT/US2013/066358 dated May 5, 2015.

Extended European Search Report for EP 13850288 dated May 18, 2016.

* cited by examiner

PRESSURE ACTIVATED DOWN HOLE SYSTEMS AND METHODS

CROSS-REFERENCE TO RELATED APPLICATIONS

This application claims the benefit of and is a continuation-in-part of U.S. patent application Ser. No. 13/350,030, filed on Jan. 13, 2012, the contents of which are hereby incorporated by reference herein in their entirety.

BACKGROUND

The present invention relates to systems and methods used in down hole applications. More particularly, the present invention relates to the setting of a down hole tool in various down hole applications using a pressure sensitive sleeve that moves when subjected to a predetermined threshold pressure.

In the course of treating and preparing a subterranean well for production, down hole tools, such as well packers, are commonly run into the well on a tubular conveyance such as a work string, casing string, or production tubing. The purpose of the well packer is not only to support production tubing and other completion equipment, such as sand control assemblies adjacent to a producing formation, but also to seal the annulus between the outside of the tubular conveyance and the inside of the well casing or the wellbore itself. As a result, the movement of fluids through the annulus and past the deployed location of the packer is substantially prevented.

Some well packers are designed to be set using complex electronics that often fail or may otherwise malfunction in the presence of corrosive and/or severe down hole environments. Other well packers require that a specialized plug or other wellbore device be sent down the well to set the packer. While reliable in some applications, these and other methods of setting well packers add additional and unnecessary complexity and cost to the pack off process.

SUMMARY

The present invention relates to systems and methods used in down hole applications. More particularly, the present invention relates to the setting of a down hole tool in various down hole applications using a pressure sensitive sleeve that moves when subjected to a predetermined threshold pressure.

In some embodiments, a system for activating a down hole tool in a wellbore can include a base pipe having an interior and a port extending between the interior and a chamber. A pressure sensitive trigger can be moveably positioned in the interior of the base pipe, the trigger including a first end having a first area, and a second end having a second area that is smaller than the first area. The trigger can be moveable between an unactivated position where the port is blocked and substantial fluid communication between the interior and the chamber is prevented, and an activated position where the port is open and fluid communication between the interior and the chamber is allowed. At least one latch member can prevent movement of the trigger from the unactivated position to the activated position until a predetermined force is applied to the trigger. Increasing a pressure in the interior can increase a force differential between the first and second end, and when the force differential is substantially equal to the predetermined force, the latch can release and allow the trigger to move from the unactivated position to the activated position, thereby opening the port and pressurizing the chamber to permit activation of the down hole tool.

In other embodiments, a method for controlling activation of a down hole tool in a wellbore can include advancing the down hole tool into the wellbore with the down hole tool being coupled to a base pipe positioned within the wellbore and the base pipe defining an interior. Pressure in the interior can be increased to create a force differential on a trigger located within the interior, the trigger having a first end with a first area and a second, opposite end with a second area that is smaller than the first area. The trigger can be moveable between an unactivated position whereby activation of the down hole tool is prevented and an activated position whereby activation of the down hole tool is permitted. Movement of the trigger from the unactivated position to the activated position can be prevented with at least one latch member until the force differential is substantially equal to a predetermined latch release force, at which point the latch member can release the trigger and the force differential can cause movement of the trigger from the unactivated position to the activated position to permit activation of the down hole tool.

In yet other embodiments, a wellbore system can include a base pipe moveable along the wellbore and defining an interior and a port extending between the interior and a chamber. A pressure sensitive trigger can be moveably positioned in the interior of the base pipe. The trigger can be moveable between an unactivated position where the port is blocked and substantial fluid communication between the interior and the chamber is prevented, and an activated position where the port is open and fluid communication between the interior and the chamber is allowed. At least one latch member can prevent movement of the trigger from the unactivated position to the activated position until a pressure in the interior is increased to a predetermined level, at which point the latch member releases the trigger and allows the trigger to move from the unactivated position to the activated position. A down hole tool can be coupled to the base pipe. An activation assembly can include a chamber in communication with the port and a piston having a first end exposed to the chamber and a second end coupled to the down hole tool. Movement of the trigger to the activated position can open the port to permit pressurization of the chamber to move the piston and activate the down hole tool.

Features and advantages of the present invention will be readily apparent to those skilled in the art upon a reading of the description of the preferred embodiments that follows.

BRIEF DESCRIPTION OF THE DRAWINGS

The following figures are included to illustrate certain aspects of the present invention, and should not be viewed as exclusive embodiments. The subject matter disclosed is capable of considerable modification, alteration, and equivalents in form and function, as will occur to those skilled in the art and having the benefit of this disclosure.

DETAILED DESCRIPTION

The present invention relates to systems and methods used in down hole applications. More particularly, the present invention relates to the setting of a down hole tool in various down hole applications using a pressure sensitive sleeve that moves when subjected to a predetermined threshold pressure.

Systems and methods disclosed herein can be configured to activate and set a down hole tool, such as a well packer, in order to isolate the annular space defined between a wellbore and a base pipe (e.g., production string), thereby helping to prevent the migration of fluids through a cement column and to the surface. Other applications will be readily apparent to those skilled in the art. Systems and methods are disclosed that permit the down hole tool to be hydraulically-set without the use of electronics, signaling, or mechanical means. The systems and methods take advantage of a sleeve positioned within the pressure differentials between, for example, the annular space between the wellbore and the base pipe and one or more chambers formed in or around the tool itself and/or the base pipe. Consequently, the disclosed systems and methods simplify the setting process and reduce potential problems that would otherwise prevent the packer or down hole tool from setting. To facilitate a better understanding of the present invention, the following examples are given. It should be noted that the examples provided are not to be read as limiting or defining the scope of the invention.

Figure 1:
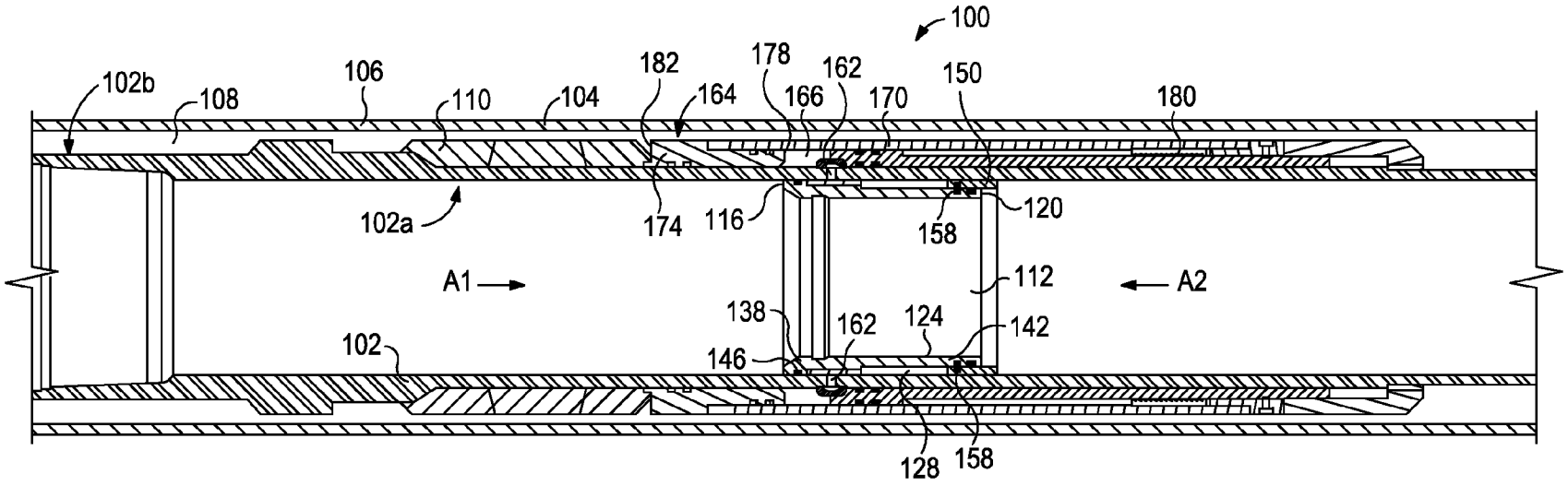
FIG. 1 illustrates a cross-sectional view of a portion of a base pipe and accompanying activation system, according to one or more embodiments disclosed.

Referring to FIG. 1, illustrated is a cross-sectional view of an exemplary activation system 100, according to one or more embodiments. The system 100 may include a base pipe 102 extending within a wellbore 104 that has been drilled into the Earth's surface to penetrate various earth strata containing, for example, hydrocarbon-bearing formations. It will be appreciated that the system 100 is not limited to use in any specific type of well, but may be used in all types, such as vertical wells, horizontal wells, multilateral (e.g., slanted) wells, combinations thereof, and the like. A casing 106 may be disposed within the wellbore 104 and thereby define an annulus 108 between the casing 106 and the base pipe 102. The casing 106 forms a protective lining within the wellbore 104 and may be made from materials such as metals, plastics, composites, or the like. In some embodiments, the casing 106 may be expanded or unexpanded as part of an installation procedure and/or may be segmented or continuous. In at least one embodiment, the casing 106 may be omitted and the annulus 108 may instead be defined between the inner wall of the wellbore 104 and the base pipe 102. In still other embodiments, the base pipe 102 may be run within another, previously set casing string.

The base pipe 102 may include one or more tubular joints, having metal-to-metal threaded connections or otherwise threadedly joined to form a tubing string. In other embodiments, the base pipe 102 may form a portion of a coiled tubing. The base pipe 102 may have a generally tubular shape, with an inner radial surface 102*a* and an outer radial surface 102*b* having substantially concentric and circular cross-sections. However, other configurations of the base pipe 102 may be suitable, depending on particular conditions and circumstances. For example, some configurations of the base pipe 102 may include offset bores, sidepockets, etc. Moreover, the base pipe 102 may include portions formed of a non-uniform construction, for example, a joint of tubing having compartments, cavities or other components therein or thereon. Even further, the base pipe 102 may be formed of various components, including, but not limited to, a joint casing, a coupling, a lower shoe, a crossover component, or any other component known to those skilled in the art. In some embodiments, various elements may be joined via metal-to-metal threaded connections, welded, or otherwise joined to form the base pipe 102. When formed from casing threads with metal-to-metal seals, the base pipe 102 may omit elastomeric or other materials subject to aging, and/or attack by environmental chemicals or conditions.

The system 100 may further include at least one down hole tool 110 coupled to or otherwise disposed about the base pipe 102. In some embodiments, the down hole tool 110 may be a packer element, such as a well packer. In other embodiments, however, the down hole tool 110 may be a casing annulus isolation tool, a stage cementing tool, a multistage tool, formation packer shoes or collars, combinations thereof, or any other down hole tool. As the base pipe 102 is run into the well, the system 100 may be adapted to substantially isolate the down hole tool 110 from any fluid actions from within the casing 106, thereby effectively isolating the down hole tool 110 so that circulation within the annulus 108 is maintained until the down hole tool 110 is actuated.

In one or more embodiments, the down hole tool 110 may include a resilient expansion element that expands radially outward when moved over a ramped element. Alternatively, the down hole tool 110 may include a compression element that expands when subjected to compression, a compressible slip on a swellable element, a compression-set element that partially collapses, a cup-type element, a chevron-type seal, one or more inflatable elements, an epoxy or gel introduced into the annulus 108, combinations thereof, or other sealing elements.

The down hole tool 110 may be disposed about the base pipe 102 in a number of ways. For example, in some embodiments the down hole tool 110 may directly or indirectly contact the outer radial surface 102*b* of the base pipe 102. In other embodiments, however, the down hole tool 110 may be arranged about or otherwise radially-offset from another component of the base pipe 102.

Figure 2:
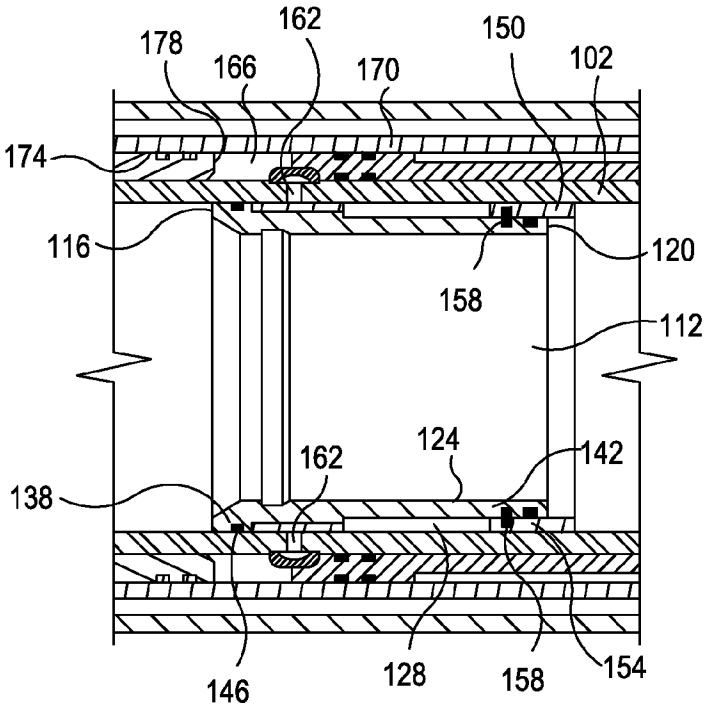
FIG. 2 illustrates an enlarged view of a portion of the activation system shown in FIG. 1 in an unactivated position.

Referring also to FIG. 2, the system 100 includes a trigger 112 that may be in the form of a pressure sensitive sleeve. The trigger 112 may be arranged within the interior of base pipe 102 and, in the illustrated configuration, may be axially movable with respect thereto. As illustrated, the trigger 112 may include a first end 116 having a first area and an opposite second end 120 having a second area that is smaller than the first area. The first and second areas may be axially projected areas obtained by calculating the area of the apparent shape of the trigger 112 when viewed in the direction of arrow A1 (FIG. 1) for the first area and in the direction of arrow A2 (FIG. 1) for the second area.

In the illustrated embodiment, the trigger 112 is substantially annular and includes a substantially constant inner diameter 124 and a stepped outer diameter 128 such that a first portion 138 of the trigger 112 adjacent the first end 116 may have a greater outer diameter and wall thickness than a second portion 142 of the trigger 112 adjacent the second end 120. Although other configurations are possible, the stepped outer diameter of the trigger 112 contributes to the resulting difference between the first area and the second area.

In the illustrated embodiment, the outer diameter of the first portion 138 of the trigger 112 may engage the inner radial surface 102*a* of the base pipe 102, and may include one or more seals 146 (one shown) positioned therebetween. Also in the illustrated embodiment, the outer diameter of the second portion 142 of the trigger 112 may engage a substantially annular collar 150 that may be fixed with respect to the base pipe 102 such that the trigger 112 is received by and axially slidable within the collar 150. As shown, the collar 150 is located in an annular space between the second portion 142 of the trigger 112 and the inner radial surface 102*a* of the base pipe 102. One or both of the collar 150 and the trigger 112 may include one or more seals 154 for sealing the engaging surfaces of the collar 150, the trigger 112, and the base pipe 102.

The system 100 may also include a force-sensitive and releasable latch for preventing substantial movement of the trigger 112 with respect to the base pipe 102 until a predetermined force is applied to the trigger 112. For example, the system 100 may include one or more shear pins 158 having a first end that is fixed with respect to the base pipe 102 and a second end that is fixed with respect to the trigger 112. In the illustrated embodiment, the pins 158 include a first end that extends into the collar 150 and a second end that extends into the trigger 112. In other embodiments, the pins 158 may extend into the base pipe 102 and the trigger 112. In still other embodiments, a shear lip, a friction fit, or another force-sensitive and releasable securement may also or alternatively be provided to prevent substantial movement of the trigger 112 with respect to the base pipe 102 until a predetermined force is applied to the trigger 112.

The system 100 may also include one or more ports 162 extending through or otherwise defined by or in the base pipe 102 and/or other system components for providing fluid communication between the interior of the base pipe 102 and a tool activation assembly 164. In the illustrated embodiment the activation assembly 164 includes an activation chamber 166 located on the exterior of the base pipe 102 and defined in part by one or more external sleeves 170 disposed about the base pipe 102. The activation assembly 164 can also include a movable element in the form of a piston 174 having a first end 178 exposed to the activation chamber 166 and a second end 182 operatively coupled to the down hole tool 110 such that movement of the piston 174 causes the down hole tool 110 to activate and set. Although the illustrated system 100 shows the piston 174 directly engaging the down hole tool 110, various sleeves, guides, and other intermediate structures can also be provided between the piston 174 and the down hole tool 110 depending on the configuration or needs of a particular application. In some embodiments, a ratchet assembly 180 can be coupled to the piston 174 and configured to permit only one-way movement of the piston in the direction that sets the down hole tool 110. In this way, the ratchet assembly 180 can secure the down hole tool 110 in the activated or set configuration.

In operation, the system 100 is advanced in the wellbore 104 until the tool 110 is at a desired location in the wellbore 104. A shutoff plug (not shown), or other type of blanking device (e.g., dart, ball, etc.), may be landed down hole of the system 100 such that a pressure increase can be observed in the interior of the base pipe 102. Pressure in the interior creates a force differential on the trigger 112 that tends to move the trigger 112 axially toward the second end 120. More specifically, because the second end 120 has a smaller area than the first end 116, the pressure in the interior creates a greater force on the first end 116 than the second end. The resulting force acting on the trigger 112 is an axial force that is substantially equal to the pressure in the interior multiplied by the difference between the first area and the second area. Accordingly, the force on the trigger 112 is proportional to the pressure in the interior, and as the pressure in the interior increases, so does the force on the trigger 112.

As discussed above, the releasable latch, which in the illustrated embodiment includes shear pins 158, prevents substantial axial movement of the trigger 112. The latch is configured to release, e.g., the pins 158 are configured to shear, in response to application of a predetermined force to the trigger 112. Thus, when the force on the trigger 112 caused by the increased pressure in the interior of the base pipe 102 becomes substantially equal to the predetermined force, the pins 158 will shear and the trigger 112 will be released for axial movement along the base pipe 102 in the direction A1.

Figure 3:
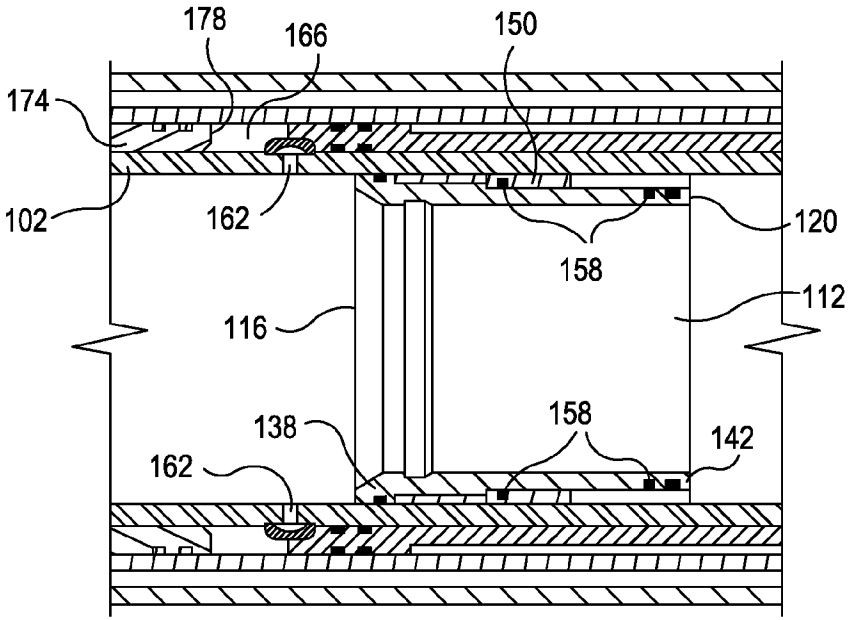
FIG. 3 illustrates the portion of the activation system shown in FIG. 2 in an activated position.

FIGS. 1 and 2 show the trigger 112 in an unactivated position before the shear pins 158 have sheared. When in the unactivated position the trigger 112 blocks or otherwise substantially occludes the port 162 and thereby prevents substantial fluid communication between the interior of the base pipe 102 and the activation chamber 166, which in turn prevents activation of the down hole tool 110. After the pins 158 have sheared and the trigger 112 is released for axial movement along the base pipe 102, the force differential caused by pressure acting on the different first and second areas of the first and second ends 116, 120 moves the trigger 112 axially in the direction A1 to the activated position shown in FIG. 3. Axial movement of the trigger 112 may be halted when the larger-outer diameter first portion 138 of the trigger 112 engages and otherwise abuts the collar 150. With the trigger 112 in the activated position, the port 162 provides fluid communication between the interior of the base pipe 102 and the activation chamber 166.

With the trigger 112 in the activated position, pressure from the interior of the base pipe 102 is communicated to the activation chamber 166. In some embodiments, the pressure required to move the trigger may be sufficient to move the piston 174. In other embodiments, after the trigger 112 has moved to the activated position, pressure in the interior of the base pipe 102 may need to be further increased to cause movement of the piston 174. In either case, as pressure from the interior of the base pipe 102 is communicated to the activation chamber 166, the pressure acts on the first end 178 of the piston 174 until a force sufficient to move the piston 174 is reached. Because the second end 182 of the piston is operatively coupled to the down hole tool 110, movement of the piston 174 causes the down hole tool 110 to activate and set.

Accordingly, the disclosed systems 100 and related methods may be used to remotely set the down hole tool 110. The trigger 112 activates the setting action of the down hole tool 110 without the need for electronic devices, magnets, or mechanical actuators, but instead relies on elevating the pressure in the interior of the base pipe 102.

In the foregoing description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended due to the details of construction or design herein shown, other than as described in the claims below. It is therefore evident that the particular illustrative embodiments disclosed above may be altered, combined, or modified and all such variations are considered within the scope and spirit of the present invention. In addition, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

What is claimed is:

1. A system for activating a down hole tool in a wellbore, the system comprising:

a base pipe having an interior and defining a port that extends between the interior and an activation chamber defined on an exterior of the base pipe;

a piston having a first end exposed to the activation chamber and a second end coupled to the down hole tool such that movement of the piston within the activation chamber acts on and activates the down hole tool;

a sleeve positioned in the interior of the base pipe and including a constant inner diameter and a stepped outer diameter such that a first axial end of the sleeve has a first area and a second axial end of the sleeve has a second area smaller than the first area;

an annular collar provided within the interior of the base pipe to receive the second axial end of the sleeve, the sleeve being moveable between an unactivated position, where the sleeve blocks the port, and an activated position, where the port is exposed and fluid communication between the interior and the activation chamber is allowed; and a latch member that prevents movement of the sleeve from the unactivated position to the activated position until a predetermined force is assumed by the sleeve, wherein increasing a pressure in the interior generates a force differential between the first and second axial ends, and when the force differential is substantially equal to the predetermined force, the latch member releases and the sleeve moves to the activated position, thereby pressurizing the activation chamber to force the piston to activate the down hole tool.

2. The system of claim 1, wherein the sleeve is moveable in a generally axial direction within the interior.

3. The system of claim 2, wherein the first area is a first axially projected area and wherein the second area is a second axially projected area.

4. The system of claim 2, wherein the force differential is an axial force that is substantially equal to the pressure in the interior multiplied by the difference between the first and second areas.

5. The system of claim 1, wherein the sleeve is substantially annular and wherein the first axial end has a first outer diameter and the second axial end has a second outer diameter less than the first outer diameter.

6. The system of claim 1, wherein the latch member includes at least one shear pin having a first end fixed with respect to the base pipe and a second end fixed with respect to the sleeve.

7. The system of claim 6, wherein the latch member couples the sleeve to the base pipe at the annular collar.

8. A method for controlling activation of a down hole tool in a wellbore, comprising:

advancing the down hole tool into the wellbore, the down hole tool being coupled to a base pipe that defines an interior and a port that extends between the interior and an activation chamber defined about an exterior of the base pipe, wherein a sleeve is positioned in the interior of the base pipe and provides a constant inner diameter and a stepped outer diameter such that a first axial end of the sleeve has a first area and a second axial end of the sleeve has a second area smaller than the first area;

increasing a fluid pressure within the interior of the base pipe and thereby generating a force differential between the first and second axial ends that acts on the first axial end to move the sleeve from an unactivated position, where the sleeve blocks the port, to an activated position, where the port is exposed;

pressurizing the activation chamber with the fluid pressure via the port, wherein a piston is positioned on the exterior of the base pipe and has a first end exposed to the activation chamber and a second end coupled to the down hole tool; and activating the down hole tool with the piston as acted upon by the fluid pressure.

9. The method of claim 8, further comprising, with the sleeve in the activated position, further increasing pressure in the interior to activate the down hole tool.

10. The method of claim 8, wherein moving the sleeve from the unactivated position to the activated position further comprises establishing fluid communication between the interior and the activation chamber to pressurize the activation chamber.

11. The method of claim 8, wherein a latch member prevents movement of the sleeve from the unactivated position to the activated position, the method further comprising increasing the fluid pressure until a predetermined force required to release the latch member is applied to the sleeve.

12. A system, comprising:

a base pipe defining an interior and a port that extends between the interior and an activation chamber defined about an exterior of the base pipe;

a sleeve positioned in the interior of the base pipe and including a constant inner diameter and a stepped outer diameter such that a first axial end of the sleeve has a first area and a second axial end of the sleeve has a second area smaller than the first area, wherein the sleeve is moveable between an unactivated position, where the sleeve blocks the port, and an activated position, where the port is exposed and fluid communication between the interior and the activation chamber is allowed;

a down hole tool coupled to the base pipe; and a piston having a first end exposed to the activation chamber and a second end coupled to the down hole tool such that movement of the piston activates the down hole tool, wherein increasing a pressure in the interior generates a force differential between the first and second axial ends and moves the sleeve to the activated position, thereby opening the port and pressurizing the activation chamber to permit the piston to act on and activate the down hole tool.

13. The system of claim 12, wherein the pressure in the interior creates a force differential between the first and second ends that urges the sleeve toward the second end.

14. The system of claim 12, further comprising a collar fixed with respect to the base pipe and slidably receiving the sleeve.

15. The system of claim 12, wherein the sleeve is moveable in a generally axial direction within the base pipe.

16. The system of claim 12, further comprising at least one latch member that prevents movement of the sleeve from the unactivated position to the activated position until a pressure in the interior is increased to a predetermined level, at which point the latch member releases the sleeve.

* * * * *